US010869133B2

(12) United States Patent
Zhang

(10) Patent No.: US 10,869,133 B2
(45) Date of Patent: Dec. 15, 2020

(54) SOUND GENERATOR

(71) Applicant: AAC Technologies Pte. Ltd., Singapore (SG)

(72) Inventor: Tong Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,096

(22) Filed: Jul. 28, 2019

(65) Prior Publication Data

US 2020/0045437 A1 Feb. 6, 2020

(30) Foreign Application Priority Data

Aug. 1, 2018 (CN) ..... 2018 2 1235540 U

(51) Int. Cl.
*H04R 9/02* (2006.01)

(52) U.S. Cl.
CPC ..... *H04R 9/025* (2013.01)

(58) Field of Classification Search
CPC . H04R 9/025; H04R 9/06; H04R 9/02; H04R 1/288; H04R 1/2811; H04R 2400/11; H04R 2400/15; H04R 1/021
See application file for complete search history.

(56) References Cited

U.S. PATENT DOCUMENTS 3,079,472 A * 2/1963 Sariti ..... H04R 9/025 381/420
9,838,796 B2 * 12/2017 Wu ..... H04R 9/06
2017/0006384 A1 * 1/2017 Wu ..... H04R 9/025

* cited by examiner

*Primary Examiner* — Sunita Joshi
(74) *Attorney, Agent, or Firm* — W&G Law Group LLP

(57) ABSTRACT

The present invention provides a sound generator. A magnetic circuit system of the sound generator forms a mortise-and-tenon structure between a magnet and a lower plate, and the magnet and a pole plate, through tenons and mortises, which enlarges the mutual contact areas, and is more convenient for processing positioning, preventing assembling dislocation, enlarging the gluing area and improving the drop reliability and therefore improving the structural stability of the magnetic circuit system.

5 Claims, 3 Drawing Sheets

SOUND GENERATOR

FIELD OF THE PRESENT DISCLOSURE

The embodiments of the invention relate to the electroacoustic components, in particular to a sound generator used in a portable device.

DESCRIPTION OF RELATED ART

Sound generators, also called sound generators, are widely used in portable electronic devices such as mobile phones, laptops, etc. With the rapid development of these portable electronic devices, people have higher and higher requirements for the performance of the sound generators. In addition, with the thinning development of mobile phones, the quality requirements for the sound generators in the mobile phones are becoming higher and higher. The sound generator is a playing device of the voice function and therefore its internal magnetic circuit system directly influences the improvement of the acoustic performance of the product.

In the sound generator of the related technology, the connection between the magnet and the lower plate, and the connection between the magnet and the pole plate are performed by glue with planar surfaces thereof attached to each other. When the sound generator drops, the structure is easy to have the problem that the glue loses effectiveness, which causes the disconnection between the pole plate and magnet, and the disconnection between the magnet and lower plate. The drop reliability is lower, and the structure stability is poor, which badly affects the acoustic performance of the sound generator. Thus, it is necessary to provide improved sound generator to solve the problems mentioned above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain the disclosure, not intended to limit the disclosure.

The following specific embodiment is provided to make the readers understand the contents of the present disclosure clearer and more thoroughly but not restrict the present disclosure, wherein, the upper, lower, left and right words indicating directions only refer to the position of the structure shown in the corresponding figure. The one near the center of the sound generator is defined inner side, and the one far from the center of the sound generator is defined the outer side.

Figure 1:
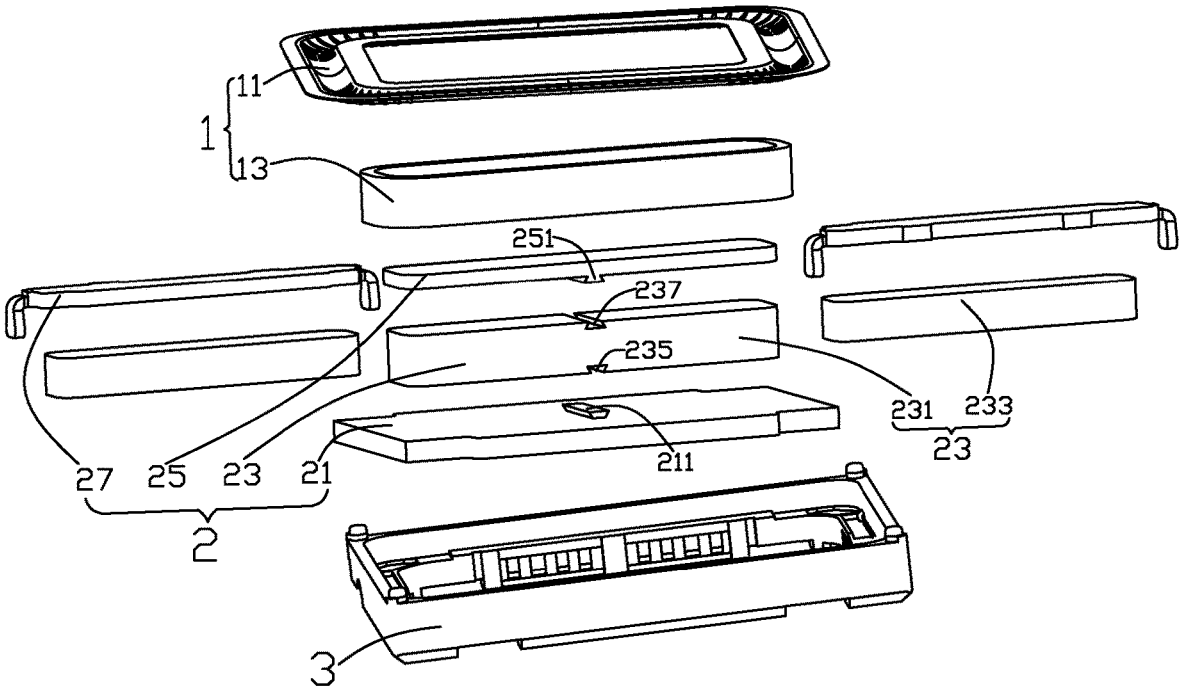
FIG. 1 is an isometric and exploded view of a sound generator in accordance with an exemplary embodiment of the invention.
Figure 2:
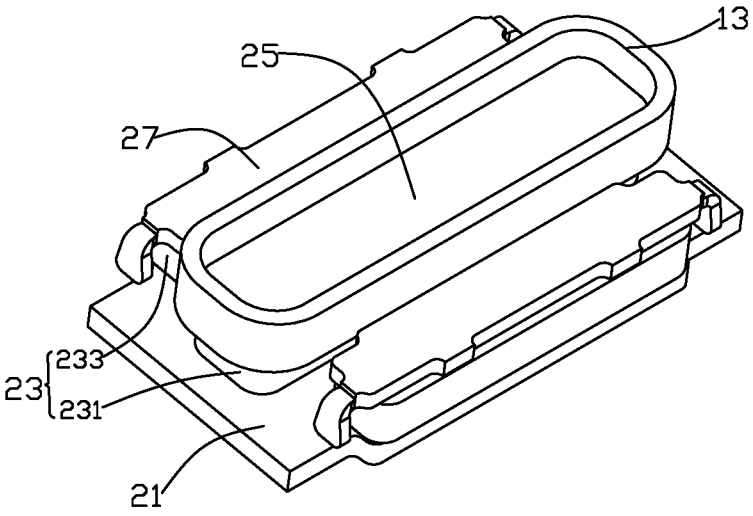
FIG. 2 an isometric view of a magnetic circuit system of the sound generator in FIG. 1.
Figure 3:
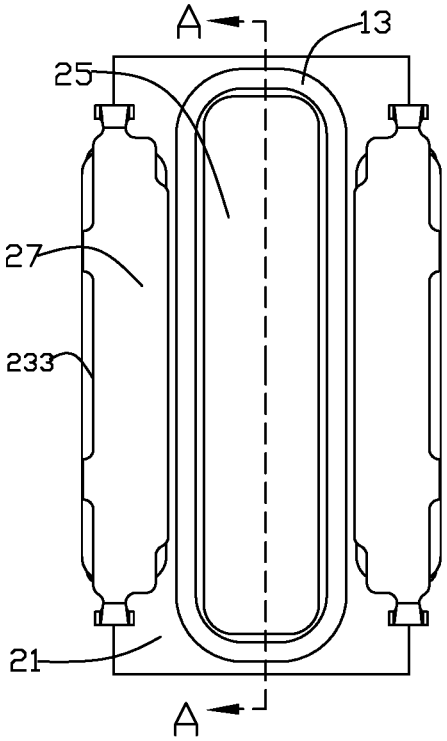
FIG. 3 is a top view of the magnetic circuit system.

As shown in FIGS. 1-3, the present disclosure provides a sound generator comprising a vibration system 1, a magnetic circuit system 2 below the vibration system 1, and a frame 3 for fixing the magnetic circuit system 2, wherein, the vibration system 1 includes a diaphragm 11 fixed at one side of the frame 3, and a voice coil 13 for driving the diaphragm 11 to vibrate to generate sound. The magnetic circuit system 2 includes a magnet 23, a lower plate 21 for carrying the magnet 23, an upper plate 27 opposite to the lower plate 21 and fixedly held on the frame 3, and a pole plate 25 arranged at a top of the magnet 23. The magnet 23 comprises a main magnet 231 and an auxiliary magnet 233 keeping a predetermined distance from the main magnet 231 for forming a magnetic gap therebetween.

In order to prevent the problem that the glue loses effectiveness, which causes the disconnection between the pole plate 25 and the magnet 23, and the disconnection between the magnet 23 and the lower plate 21, the present disclosure improves the structure of the magnetic circuit system 2, as follows:

In the embodiment, a surface where the main magnet 23 and the lower plate 21 are engaged (facing the lower plate 21) is defined as a first surface, and a surface where the main magnet 23 and the pole plate 25 are engaged (opposite from the first surface) is defined as a second surface. As shown in FIG. 2, an upper surface of the lower plate 21 is adhered with the main magnet 231 and the auxiliary magnet 233 which is at both sides of the main magnet 231 and arranged with an interval from the main magnet 231. The first surface and the second surface of the main magnet 231 respectively form a first mortise 235 and a second mortise 237. The upper surface of the lower plate 21 forms a first tenon 211 matching the shape of the first mortise 235. The first tenon 211 protrudes from the upper surface of the lower plate 21 towards the main magnet 231 (toward the first surface). The first tenon 211 and the first mortise 235 are fixedly gripped to make the main magnet 231 and the lower plate 21 be fixedly engaged. Thus, a contact area between the main magnet 231 and the lower plate 21 is enlarged, and a first mortise-and-tenon structure is formed. As shown in FIGS. 1-2, the main magnet 231 is a rounded rectangle. A length of the first mortise 235 and A length of the second mortise 237 are same as the width of the main magnet. The first mortise 235 and the second mortise 237 pass through the two opposite sides of the magnet. The depth of the first mortise 235 is same or not the same as that of the second mortise 237. Preferably, the first mortise 235 and the second mortise 237 are arranged at a central area of the main magnet but can also be arranged at other positions as required. It needs to explain that the auxiliary magnet 233 can also form the first mortise 235 and/or the second mortise 237. The above is only used for description but cannot be understood as the restriction of the present disclosure.

Further, a lower surface of the pole plate 25 forms a second tenon 251 matching the shape of the second mortise 237, and the second tenon 251 protrudes from the lower surface of the pole plate 25 towards the main magnet 231 (toward the second surface). In the same way, the first tenon 251 and the second mortise 237 are fixedly gripped to make the pole plate 25 and the main magnet 231 be fixedly engaged, which enlarges the contract area between the main magnet 231 and the pole plate 25, and therefore a second mortise-and-tenon structure is formed. Therefore, the structural stability of the sound generator is improved, and the flux transfer area is improved. When fixed by gluing, the second mortise-and-tenon structure enlarges the contact area between the main magnet 231 and the lower plate 21 and the one between the main magnet 231 and the pole plate 25, and improves their connection strength, improves the adhering strength. It is more convenient for processing positioning, prevents assembling dislocation, enlarges gluing area, and improves the drop reliability and therefore improves the structural stability of the magnetic circuit system.

Figure 4:
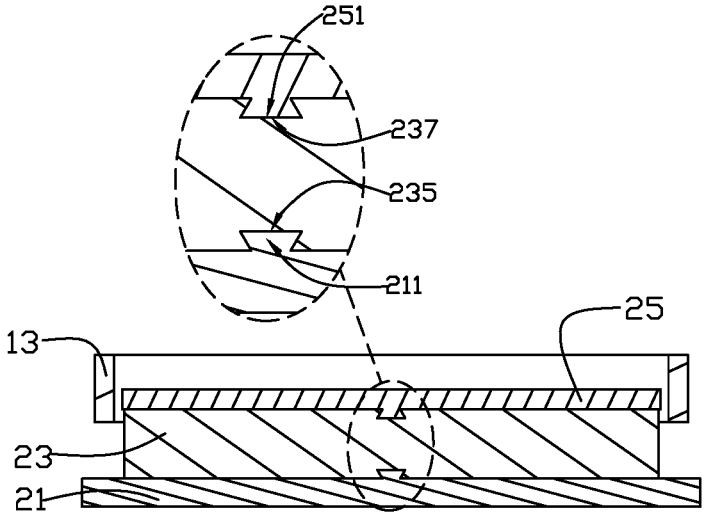
FIG. 4 is a cross-sectional view taken along line A-A in FIG. 3.

Indicated by FIG. 4, a depth of the first mortise 235 is the distance that the first tenon 211 protrudes from the lower plate 21 to the first surface, and the depth of the second mortise 237 is the distance that the second tenon 251 protrudes from the pole plate 25 to the second surface.

Further, the upper plate 27 is overlapped on the auxiliary magnet 233; and the voice coil 13 is arranged around the main magnet 231, and leads out the flux of the main magnet 231 with the lower plate 21 and the pole plate 25 to form a magnetic field environment and make the voice coil 13 be in the magnetic field environment. Specifically, the voice coil 13 is in a runway shape and the voice coil 13 is arranged in the magnetic gap. After the voice coil 13 is electrified, the voice coil 13 is driven by the magnetic field environment to vibrate.

Compared with the related art, the sound generator of the present disclosure forms the mortise-and-tenon structure between the magnet and the lower plate, and the magnet and the pole plate, through tenons and mortises, which enlarges the mutual contact areas, is more convenient for processing positioning, preventing assembling dislocation, enlarging the gluing area and improving the drop reliability and therefore improving the structural stability of the magnetic circuit system.

It is to be understood, however, that even though numerous characteristics and advantages of the present exemplary embodiment have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator, including;

a magnetic circuit system comprising a magnet and a lower plate for carrying the magnet, and the magnet including a first surface facing the lower plate and a second surface opposite to the first surface; wherein the first surface of the magnet forms a first mortise, and the lower plate forms a first tenon protruding toward the magnet and matching the first mortise, and the first mortise and the first tenon are fixedly gripped with each other, the magnetic circuit system further comprises a pole plate covering the second surface of the magnet, the second surface of the magnet forms a second mortise, the pole plate forms a second tenon protruding toward the magnet and matching the second mortise, and the second mortise and the second tenon are fixedly gripped with each other.

2. The sound generator as described in claim 1, wherein the first mortise passes through two opposite sides of the magnet.

3. The sound generator as described in claim 1, wherein the second mortise passes through two opposite sides of the magnet.

4. The sound generator as described in claim 1, wherein the first mortise is arranged at a center of the magnet.

5. The sound generator as described in claim 1, wherein the second mortise is arranged at a center of the magnet.

* * * * *